US006327712B1

(12) United States Patent
Armstrong et al.

(10) Patent No.: US 6,327,712 B1
(45) Date of Patent: Dec. 11, 2001

(54) COMBINATION NURSING BIB

(75) Inventors: Darci C. Armstrong, 231 Capital Rd., Lawson, CO (US) 80435; Vicki T. Armstrong, Englewood, CO (US)

(73) Assignee: Darci C. Armstrong, Lawson, CO (US)

( * ) Notice: Subject to any disclaimer, the term of this patent is extended or adjusted under 35 U.S.C. 154(b) by 0 days.

(21) Appl. No.: 09/385,562

(22) Filed: Aug. 30, 1999

(51) Int. Cl.[7] ..... A41D 1/20
(52) U.S. Cl. ..... 2/104; 2/49.1; 2/46
(58) Field of Search ..... 2/104, 49.1, 114, 2/48, 46, 49.4, 49.5, 52, 106, 105, 109, 50, 51

(56) References Cited

U.S. PATENT DOCUMENTS

| | | | | |
|---|---|---|---|---|
| D. 357,568 | * | 4/1995 | Schottland | D2/861 |
| 1,098,155 | * | 5/1914 | Knapp . | |
| 1,206,480 | * | 11/1916 | Stagg . | |
| 1,290,142 | * | 1/1919 | Elowsky . | |
| 1,989,382 | * | 1/1935 | Schnaittacher | 128/280 |
| 2,857,599 | * | 10/1958 | Wallace | 2/49 |
| 3,131,399 | * | 5/1964 | Murphy et al. . | |
| 3,154,789 | * | 11/1964 | Lewis, Jr. | 2/104 |
| 4,144,593 | * | 3/1979 | Timmons . | |
| 4,458,365 | * | 7/1984 | Wood | 2/104 |
| 4,528,699 | * | 7/1985 | Hughes | 2/104 |
| 4,566,136 | * | 1/1986 | Echols | 2/104 |
| 4,601,068 | * | 7/1986 | Frechette | 2/104 |
| 4,660,227 | * | 4/1987 | Abramson | 2/104 |
| 4,663,782 | * | 5/1987 | Knox et al. | 2/104 |
| 4,697,287 | * | 10/1987 | Rose | 2/49 |
| 4,797,953 | * | 1/1989 | Dameron | 2/104 |
| 5,459,877 | * | 10/1995 | Roberti | 2/104 |
| 5,611,086 | * | 3/1997 | Eggen | 2/104 |
| 5,839,924 | * | 11/1998 | Miller | 450/58 |

* cited by examiner

*Primary Examiner*—Amy B. Vanatta
(74) *Attorney, Agent, or Firm*—John L. Isaac; Isaac & Associates

(57) ABSTRACT

A protective covering is disclosed for safeguarding the clothing of a nursing mother from being soiled during nursing of an infant. The covering includes a first member having an upper portion for positioning about the upper torso of a wearer. A pair of flap members depend from the upper portion and are arranged for selective covering of the breasts of the wearer. A second member is sized and shaped for covering the lower torso and lap of the wearer and has an upper edge adapted for positioning proximate to and beneath the breasts of the wearer. The second member is attached to the first member such that the flap members extend over the second member below the upper edge and downwardly toward the waist area of the wearer to provide ease of access to the breasts of the wearer as well as modesty protection during the nursing of an infant. In one arrangement of the invention, each of the flap members includes a plurality of selectively attachable fastening elements disposed thereon to enable the flap member to form a pocket when folded back onto itself for containing a hot or cold pack against the breast of the wearer.

24 Claims, 5 Drawing Sheets

COMBINATION NURSING BIB

BACKGROUND OF THE INVENTION

1. Field of the Invention

The present invention relates generally to wearing apparel for nursing mothers and, more particularly, to protective coverings to prevent clothes from being soiled during the process of nursing an infant. Specifically, the present invention relates to an improved combination overwear protective garment for nursing mothers.

2. Description of the Prior Art

During the process of breast feeding or nursing an infant, it is unfortunately common that the infants frequently drool, burp or regurgitate when being held by the nursing mother. Articles designed to prevent the soiling of clothes when an infant is held during nursing are well known in the art. These devices frequently consist of a cloth, dishrag or cloth diaper being placed over a mother's shoulder or lap while holding and nursing the infant. The primary function of these articles is to prevent the soiling of the adult's clothes and skin when an infant regurgitates, drools or burps. Examples of such bib-like devices include those illustrated in U.S. Pat. Nos. 2,857,599, 4,697,287 and 5,459,877. Notwithstanding their common uses, these bib-like devices do have certain limitations. Often, the contents of the infant's mouth will not be entirely retained by the dishrag or diaper, thus soiling nearby clothes. Moreover, these types of devices do not cover the entire front torso of the nursing mother thereby leaving large portions of the nursing mother's clothing unprotected should the child spit-up or drool without warning.

To overcome the limitations of these bib-like devices, an alternate solution has been posed in the prior art wherein entire gowns are provided for the nursing mother to wear. Examples of such garments are illustrated in U.S. Pat. Nos. 4,458,365 and 5,611,086. Unfortunately, these devices are intended to generally cover the entire body of the nursing mother, not just the front of her torso which is the area requiring protection. Thus, unnecessary cloth material is used in these devices. Moreover, some may even require that the nursing mother disrobe before putting on the garment. Consequently, these particular devices are far more complicated to use as well as being complicated in structure to permit access for the baby to the breast of the nursing mother.

Another one of the unavoidable consequences of pregnancy, childbirth and breast-feeding is postpartum breast engorgement and enlargement as well as breast tenderness from feeding. Women suffering from such conditions experience significant pain and discomfort of the breasts. For women who choose not to breast feed, lactation suppressants can be used to prevent engorgement and, consequently, concomitant discomfort. However, many women choose not to take pharmaceutical drugs to address this problem. Moreover, women who are nursing simply cannot utilize such drugs since this would be counterproductive to nursing. Consequently, doctors generally recommend the use of thermal compresses, such as ice or heat packs. Unfortunately, the use and positioning of such thermal compresses or packs may be difficult or inappropriate under certain circumstances and situations. While bra structures have been designed to accommodate this problem as well as leakage, such as illustrated in U.S. Pat. Nos. 1,989,382 and 5,839,942, these structures do not address the clothing soiling problem resulting from infant nursing previously discussed.

Accordingly, there remains a need to provide an improved device which is designed to protect the front of the outer clothing of a nursing mother without their having to remove their clothing and which is easy to put on and take off. Moreover, there remains a need for such a device which also addresses the problem of breast engorgement and sensitivity resulting from childbirth and breast-feeding.

SUMMARY OF THE INVENTION

Accordingly, it is one object of the present invention to provide a protective covering to safeguard the clothing of a nursing mother from being soiled during the process of nursing an infant.

It is another object of the present invention to provide such a protective covering which also provides breast support as well as permits easy access to the breast for nursing.

Yet another object of the present invention is to provide such a device which also acts as a modesty protection member during the process of infant nursing.

Still another object of the present invention is to provide a combination nursing bib and thermal compresses carrier which not only protects the clothing of the nursing mother but also permits the easy application of heat or cold packs to the breasts of the nursing mother.

To achieve the foregoing and other objects and in accordance with the purpose of the present invention, as embodied and broadly described herein, a protective covering is disclosed for safeguarding the clothing of a nursing mother from being soiled during nursing of an infant. The covering includes a first member having an upper portion for positioning about the upper torso of a wearer. A pair of flap members depend from the upper portion and are arranged for selective covering of the breasts of the wearer. A second member is sized and shaped for covering the lower torso and lap of the wearer and has an upper edge adapted for positioning proximate to and beneath the breasts of the wearer. The second member is attached to the first member such that the flap members extend over the second member below the upper edge and downwardly toward the waist area of the wearer to provide ease of access to the breasts of the wearer as well as modesty protection during the nursing of an infant.

In one arrangement of the invention, the second member includes the upper edge, a lower edge and opposing side edges. The second member is then attached to the first member proximate the upper corners of the second member defined by the junction of the upper edge and the opposing side edges. Moreover, the upper edge of the second member may include a reinforced lip for providing comfort as well as support for the breasts of a wearer during nursing. In yet another aspect of the invention, the second member is constructed from an outer layer of soft, absorbent material and an inner layer of firm, liquid impermeable material, while the first member is constructed from soft, absorbent material.

In another arrangement of the invention, the upper portion of the first member includes a top edge having a recess and first attachment members for securing the first member about the neck of a wearer, while the second member includes second attachment members for securing the second member about the torso of the wearer.

In yet another arrangement of the invention, each of the flap members includes a plurality of selectively attachable fastening elements disposed thereon to enable the flap member to form a pocket when folded back onto itself. In one aspect of this arrangement, each of the flap members includes an outer edge, an inner edge, a lower edge, and at least four of the selectively attachable fastening elements.

One of the fastening elements is disposed proximate the flap member lower edge, while a second fastening element is disposed at the top of the flap member proximate the junction of the flap member and the first member upper portion. The third and fourth fastening elements are spaced along the flap member outer edge with the first and second fastening elements being adapted for selective attachment with each other and the third and fourth fastening elements being adapted for selective attachment with each other to form the pocket which is accessible through the inner edge of the flap element. In a preferred arrangement, the fastening elements comprise hook and loop fasteners.

A further arrangement of the invention is in the form of a protective and modesty garment with thermal compress carrying capability for use by a woman breast-feeding an infant. The garment includes a bib member sized and shaped for substantially covering the front torso area of a wearer. The bib member has an upper portion with a cutout neck portion and first attachment members for detachably fastening the bib member around the neck of the wearer. A pair of flaps depend from the upper portion with each flap being arranged for covering a breast of the wearer and extending downwardly toward the waist area of the wearer to provide selective access to the wearer's breasts as well as modesty protection to cover the breast and head of an infant during the nursing of an infant. Second attachment members are provided for detachably fastening the bib member around the torso of the wearer. Finally, a plurality of fastening elements are disposed on each flap and are positioned for selective attachment when each flap is folded back onto itself to form a pouch adapted to carry a thermal compress member positioned over a breast of the wearer.

In another aspect of this arrangement, the garment may further include a lap-covering member sized and shaped for covering and protecting the lower torso and lap of the wearer. This lap covering member has an upper edge adapted for positioning proximate to and beneath the breasts of the wearer and includes third attachment members for selectively securing the lap covering member about the torso of the wearer such that the flaps of the bib member extend over the lap covering member downwardly toward the waist area of the wearer. The top bib member and the lap-covering member may remain independent of each other, or they may be secured to each other to form a single unit.

Another arrangement of the invention is in the form of a nursing garment for a woman breast-feeding an infant. This garment is a lap bib sized and shaped for covering and protecting the lower torso and lap of a wearer and has opposing side edges with an upper edge adapted for positioning proximate to and beneath the breasts of the wearer for support during the nursing of an infant. The lap bib includes a first attachment member for selectively securing the lap bib about the neck of the wearer and second attachment members secured to the side edges for selectively securing the lap bib about the torso of the wearer such that the lap of the wearer is covered and protected from soiling during the nursing of an infant. The lap bib is constructed from an outer layer of soft, absorbent material and an inner layer of firm, liquid impermeable material. In another aspect of this arrangement, the nursing garment further includes a chest bib sized and shaped for substantially covering the front torso area of the wearer. The chest bib has an upper portion with a cutout neck portion and third attachment members for detachably fastening the chest bib around the neck of the wearer. A pair of depending flaps are arranged for covering the breasts of a wearer and extend downwardly toward the waist area of the wearer to provide selective access to the wearer's breasts as well as modesty protection during the nursing of an infant. Fourth attachment members are provided for detachably fastening the chest bib around the torso of the wearer, the chest bib being constructed from soft, absorbent material.

BRIEF DESCRIPTION OF THE DRAWINGS

The accompanying drawings which are incorporated in and form a part of the specification illustrate preferred embodiments of the present invention and, together with a description, serve to explain the principles of the invention. In the drawings.

DETAILED DESCRIPTION OF THE PREFERRED EMBODIMENTS

Referring first to FIGS. 1–7, a combination nursing bib and thermal carrier device 10 is illustrated. The primary functions and purposes of the device 10 are to first protect the outer garments of a nursing mother 12 wearing the device 10. Secondly, the device 10 is designed to provide easy access to the breasts 14 of the mother 12 for nursing while simultaneously providing modesty protection during nursing. Additionally, the device 10 is designed to provide support to the breasts 14 of the mother 12 while nursing. Finally, the device 10 is designed to act as a thermal carrier device so that heat or cold packs may be applied to the breasts 14 of the mother 12 to ease pain or tenderness resulting from engorgement and nursing.

Figure 1:
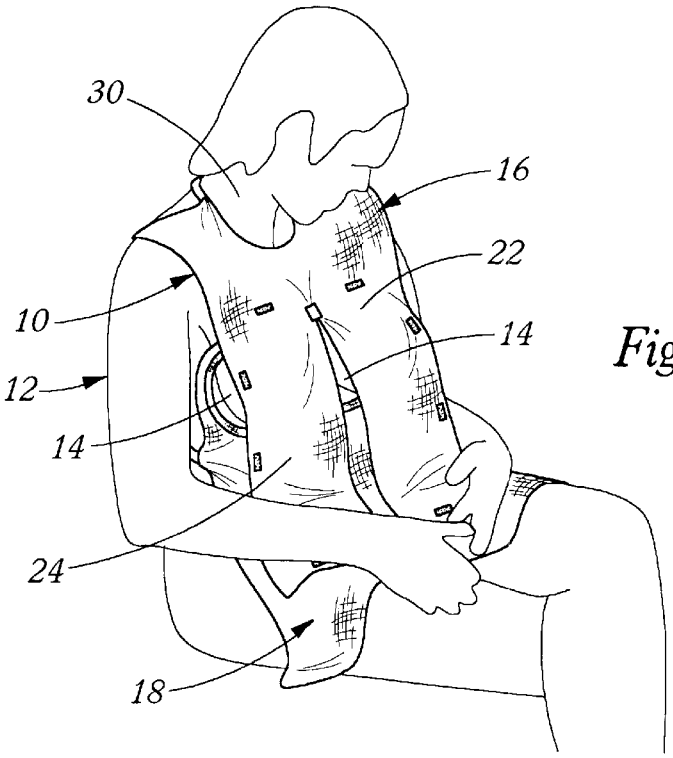
FIG. 1 is a front perspective view of the combination covering and carrier device of the present invention in position on a nursing mother.
Figure 2:
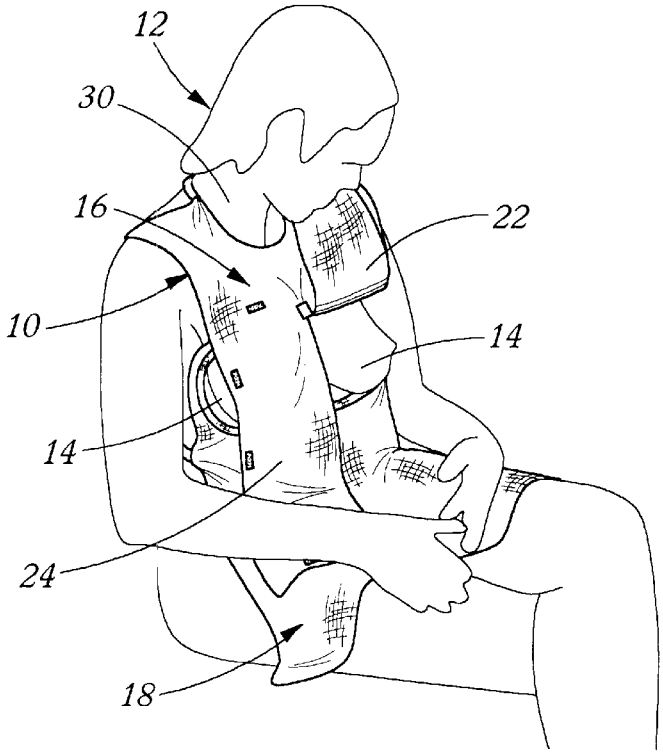
FIG. 2 is a view similar to that of FIG. 1 but illustrating repositioning of a portion thereof for access to the breast of the wearer.
Figure 3:
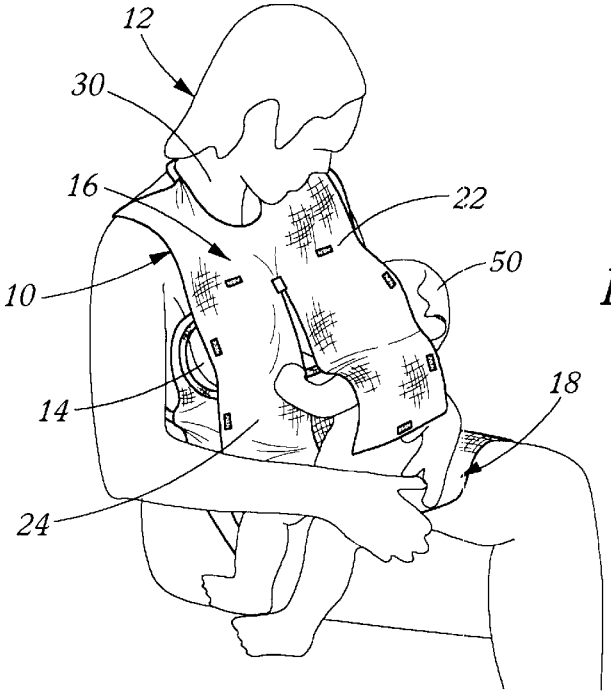
FIG. 3 is a view similar to that of FIG. 2 but illustrating an infant in positioned for nursing with the device positioned for modesty protection during nursing.

To accomplish these multiple functions, the device 10 preferably includes a first or upper bib member 16 and a second or lower bib member 18. While the upper and lower bib members 16, 18 may be separate independent units, in this particular embodiment they are preferably attached to form a single integral device 10 as described in greater detail below. The first or upper bib member 16 is preferably made from a soft, liquid absorbent material 62 such as terry cloth. It should be noted, however, that any type of liquid absorbent material or cloth may be used. The upper bib member 16 includes an upper portion 20 and a pair of flaps 22, 24 which are preferably integral with the upper portion 20 and depend therefrom. The upper portion 20 is sized and shaped to preferably cover the upper chest and front shoulder area of the wearer 12 as illustrated in FIGS. 1–3. The top edge 26 of the upper portion 20 includes a recessed or notched area 28 which is designed to be placed around the neck 30 of a wearer 12. First attachment members preferably in the form of string ties 32, 34 are provided at the ends of the notched area 28 to secure the first member 16 to the wearer 12. It should be understood, however, that any type of known device can be used as the attachment members 32, 34.

The flaps 22, 24 depend from the upper portion 20 toward the waist of a wearer 12 and are sized and shaped to fully cover the breasts 14 of the wearer 12 when in their downwardly depending position as illustrated in FIGS. 1 and 3. The flap 22 includes an outer edge 36, an inner edge 38 and a bottom edge 40. Likewise, the flap 24 includes an outer edge 42, an inner edge 44 and a bottom edge 46. The inner edges 38, 44 of the flaps 22, 24, respectively, are joined at a reinforcement member 48 at the junction with the upper portion 20. When it is desired to nurse an infant 50, a flap 22, 24 is lifted to an upper position such as illustrated in FIG. 2 to expose or access a breast. 14. An infant 50 is then positioned for nursing, and the flap 22, 24 is then repositioned in its downwardly depending position to cover the head of the infant 50 and the breast 14 of the nursing mother 12 to provide modesty protection and coverage during nursing, as illustrated in FIG. 3. Since the flaps 22, 24 are made from soft, liquid absorbent material, they are very flexible and easily adjusted to position an infant 50 for nursing while retaining full modesty by non-exposure of a breast 14. Moreover, the absorbent material of the flaps 22, 24 enable easy absorption of milk which is spit-up or regurgitated by the infant 50 during nursing.

The second or lower bib member 18 includes a large, generally rectangular portion 52 having a bottom edge 54, a pair of opposing side edges 56, 58 and an upper edge 60. The portion 52 is sized and shaped to cover the lower torso and lap area of a wearer 12. The second or lower bib member 18 is preferably constructed from two different materials. In preferred form these include a soft, liquid absorbent material such as terry cloth making up the upper surface 62 thereof, and a firm, liquid impermeable material such as vinyl making up the bottom surface 64. This prevents liquid from seeping through to the underlying clothes of the wearer 12. It should be understood that any type of soft, liquid absorbent cloth and any type of firm, liquid impermeable cloth may be utilized with the present invention.

The second or lower bib member 18 is preferably secured to the upper bib member 16. In preferred form, the portion 52 is secured to the upper portion 20 of the first bib member 16 utilizing a pair of attachment strips 66, 68 which project from the junctions of the upper edge 60 and the side edges 56, 58. The attachment strips 66, 68 extend behind the upper portion 20 of the upper bib member 16 and are affixed thereto by any known manner, such as by sewing, stapling and the like. In preferred form, the upper edge 60 includes a reinforcement member 70 sized and shaped for positioning immediately below the breasts of a wearer 12. The reinforcement member 70 is preferably an enlarged, soft ribbing material designed to provide comfort and support immediately to the lower surface of the wearer's breasts. A pair of attachment members 72, 74 project, respectively, from the side edges 56, 58 of the portion 52. The attachment members 72, 74 are designed to secure the lower bib member 18 about the torso of a wearer 12.

As can be clearly seen from FIGS. 1–3, the lower bib member 18 is sized and shaped to cover the lower front portion of a wearer's torso immediately below the breasts and to extend over the lap of the wearer 12. The upper bib member 16 is sized and shaped to cover the upper chest or torso area of a wearer 12 with the flaps 22, 24 extending over the wearer's breasts and down below the waist of the wearer 12. As described above, the upper surfaces of both upper bib member 16 and lower bib member 18 are made from soft, liquid absorbent material so that any milk or liquid spit-up or regurgitated by an infant 50 is readily absorbed thereon. Moreover, the bottom liquid impermeable layer 64 of the lower bib member 18 prevents any such liquid from soaking through the lower bib member 18 onto the clothing of the wearer 12. Thus, the outer clothing of the wearer 12 is protected. Moreover, the device 10 is easily secured to as well as removed from a wearer 12 by simply draping it across the front of a nursing mother, securing the attachment members 32, 34 about the neck and the attachment members 72, 74 about the torso of the wearer 12.

Figure 4:
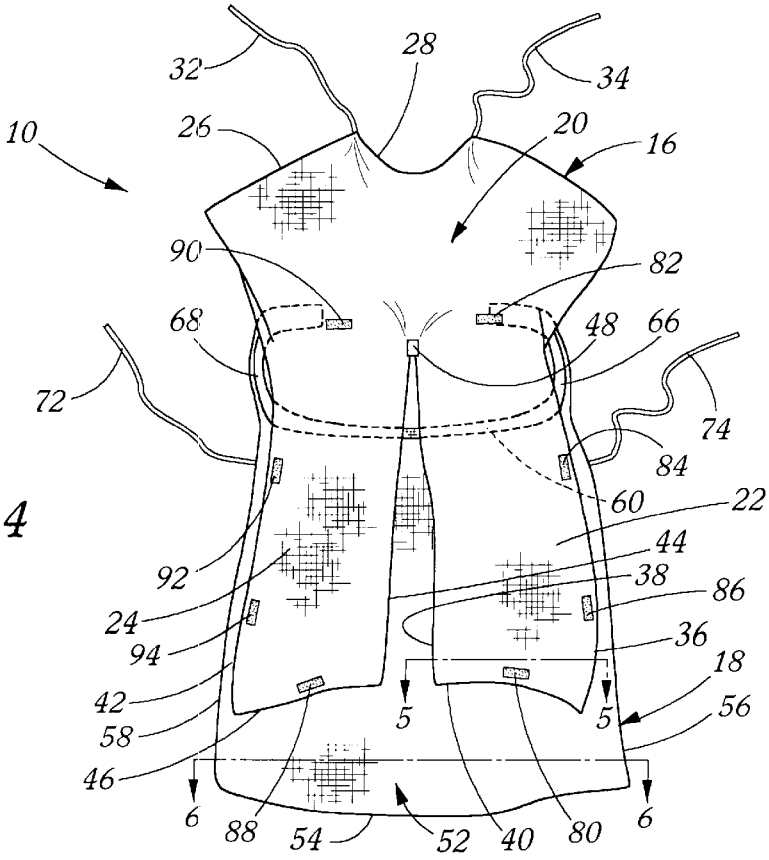
FIG. 4 is a front view in elevation of a garment constructed in accordance with one embodiment of the present invention.
Figure 5:
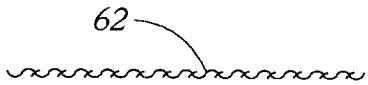
FIG. 5 is a cross-sectional view taken substantially along line 5—5 of FIG. 4.
Figure 6:
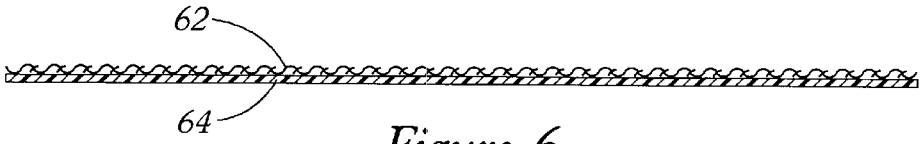
FIG. 6 is a cross-sectional view taken substantially along line 6—6 of FIG. 4.
Figure 7:
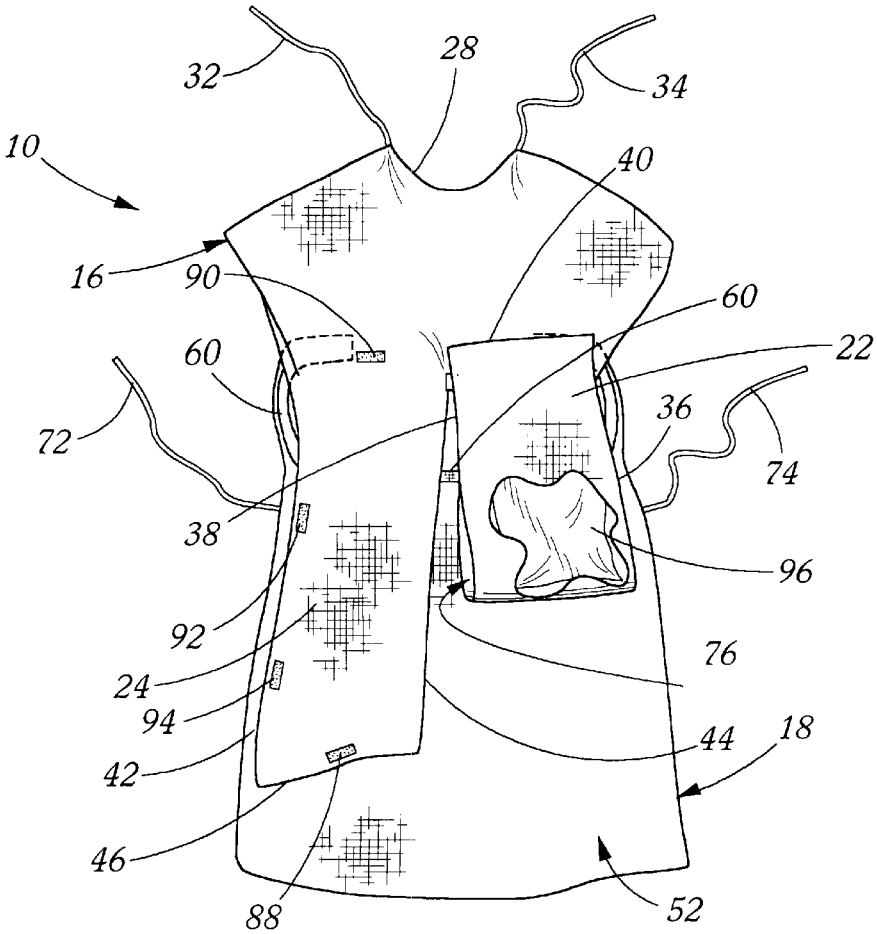
FIG. 7 is a front view in elevation, with parts broken away, similar to that of FIG. 4 but illustrating a flap member portion thereof folded as a thermal pack carrier.
Figure 8:
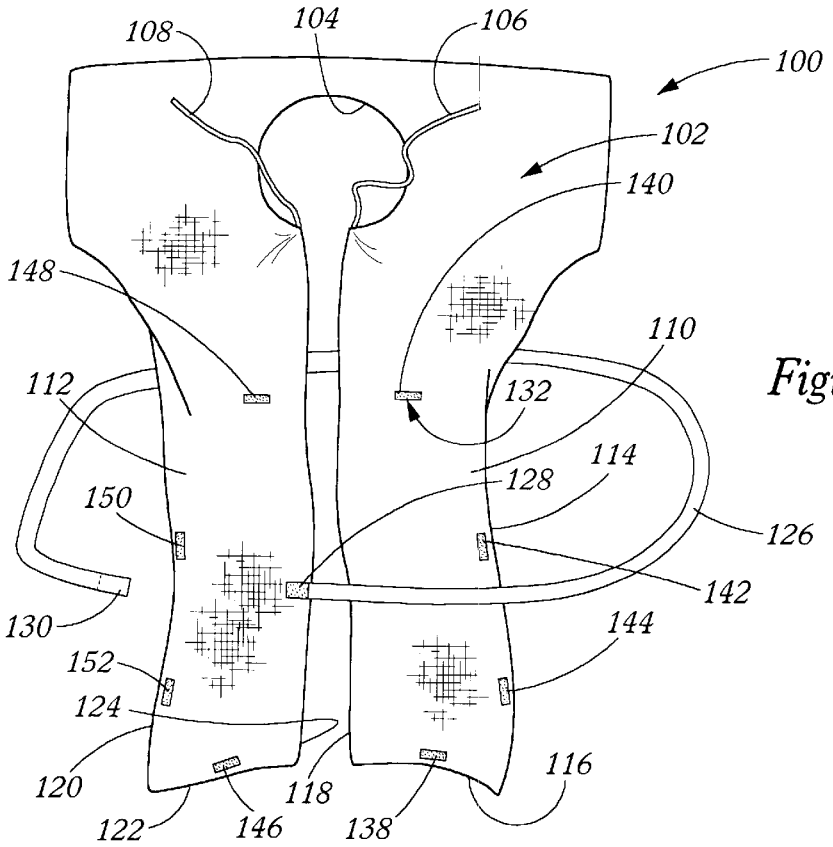
FIG. 8 is a front view in elevation of an alternate embodiment of a device constructed in accordance with the present invention.

Referring now with particularity to FIGS. 4 and 7, the flaps 22, 24 can each be folded back onto itself to form a pocket or pouch 76 which is designed to carry a heat pack or a cold pack in position immediately over a breast 14 of a wearer 12. This is to assist in relieving the problem of pain arising from breast engorgement or sensitivity from nursing. Each flap 22, 24 includes a plurality of attachment elements positioned thereon to create the pouch 76 for the heat or cold pack 96 when the flap 22 or 24 is folded back onto itself. In preferred form, a first attachment element 80 is positioned immediately proximate the lower edge 40 on the flap 22 while a second attachment element 82 is positioned at the top of the flap 22 immediately proximate the junction of the flap 22 and the upper portion 20, these attachment elements 80 and 82 being designed to secure to each other when the flap 22 is folded back onto itself. In addition, the flap 22 includes a third attachment element 84 and a fourth attachment element 86 spaced from each other along one side edge and preferably the outer side edge 36 so that these elements 84 and 86 secure to each other when the flap 22 is folded back onto itself. In preferred form, all of the elements 80, 82, 84 and 86 are hook and loop fasteners such as Velcro.

The other flap 24 likewise has a first attachment element 88 along the bottom side edge 46, a second attachment element 90 at the junction of the flap 24 and the upper portion 20, and third and fourth attachment elements 92, 94 spaced along the side edge 42. These elements 88, 90, 92 and 94 interconnect when the flap 24 is folded back onto itself in the same manner as the elements 80, 82, 84 and 86 of the flap 22. It should be understood that the placement and number of attachment elements 80–94 may be varied according to the needs and desires of a nursing mother. In this embodiment, the pouch 76 of each folded flap 22, 24 is accessed for inserting or removing a thermal carrier 96, i.e. a heat or cold pack, through the opening created in the respective inner side edges 38, 44 of the flaps 22, 24. It should be understood, however, that the attachment elements 84, 86 and 92, 94 may be positioned along the inner side edges 38, 44 respectively so as to permit access to the pouch or pocket 76 through the outer side edges 36, 42.

Referring now with particularity to FIGS. 8–11, the upper and lower bib members 16, 18 of the previously described embodiment may be modified so that they may be used separately and independently from each other. In this modified embodiment, a protective and modesty garment 100 is illustrated which is similar in function to the upper bib member 16 of the prior embodiment. The garment 100 includes an upper portion 102 which is sized and shaped to cover the chest and shoulder area of a wearer. The upper portion 102 includes a notched out portion 104 which is designed to be placed around the neck of a wearer. In this embodiment, the upper portion 102 preferably encircles the neck of a wearer when positioned thereon. A pair of attachment members in the form of a pair of string ties 106, 108 are provided for securing the upper portion 102 in place about the neck of a wearer.

A pair of flap members 110, 112 depend downwardly from the upper portion 102. The flap member 110 includes an outer edge 114, a bottom edge 116 and an inner edge 118. Likewise, the other flap member 112 includes an outer edge 120, a bottom edge 122 and an inner edge 124. The inner edges 118, 124 preferably extend the entire length of their respective flap members 110, 112 from their respective bottom edges 116, 122 up to the neck opening 104. The flap members 110, 112 are designed to operate the same as the flaps 22, 24 of the prior embodiment. They are designed to extend down over the breasts of a wearer and to provide modesty protection for a wearer during nursing of an infant. Since the garment 100 is independent of any other article, an attachment mechanism is provided for holding the garment 100 onto the torso of a wearer. In preferred form, a single nylon strap or belt 126 is secured at 128 to the inner side edge 124 of the flap member 112 and is designed to cross over the opposite flap member 110 and extend all around the torso of the wearer. Once the strap 126 has encircled the torso of the wearer, the distal end 130 is secured to an appropriate attachment member at the site 128. In preferred form, the distal end 130 and the site 128 are hook and loop fasteners so that they are readily attached and detached at the will of the wearer. Moreover, the fact that the strap 126 preferably crosses over both flap members 110, 112 aids in the folding and retaining of the flap members 110, 112 when it is desired to form pouches for hot or cold packs as described below.

Figure 9:
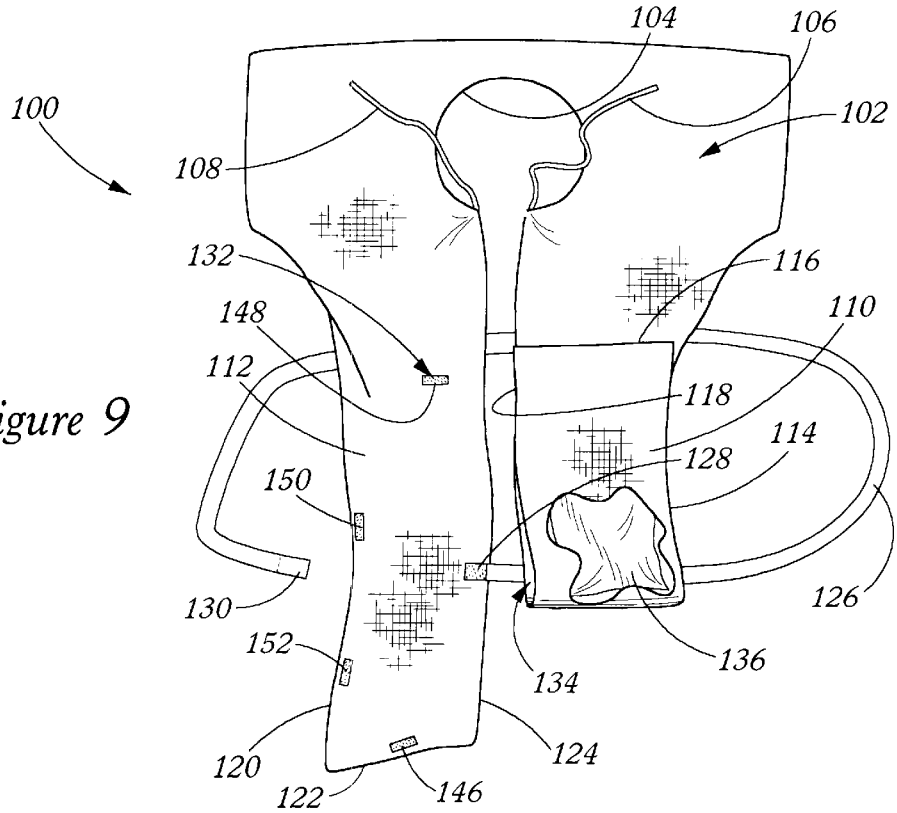
FIG. 9 is a front view in elevation, with parts broken away, similar to that of FIG. 8 but illustrating a flap member portion thereof folded as a thermal pack carrier.
Figure 10:
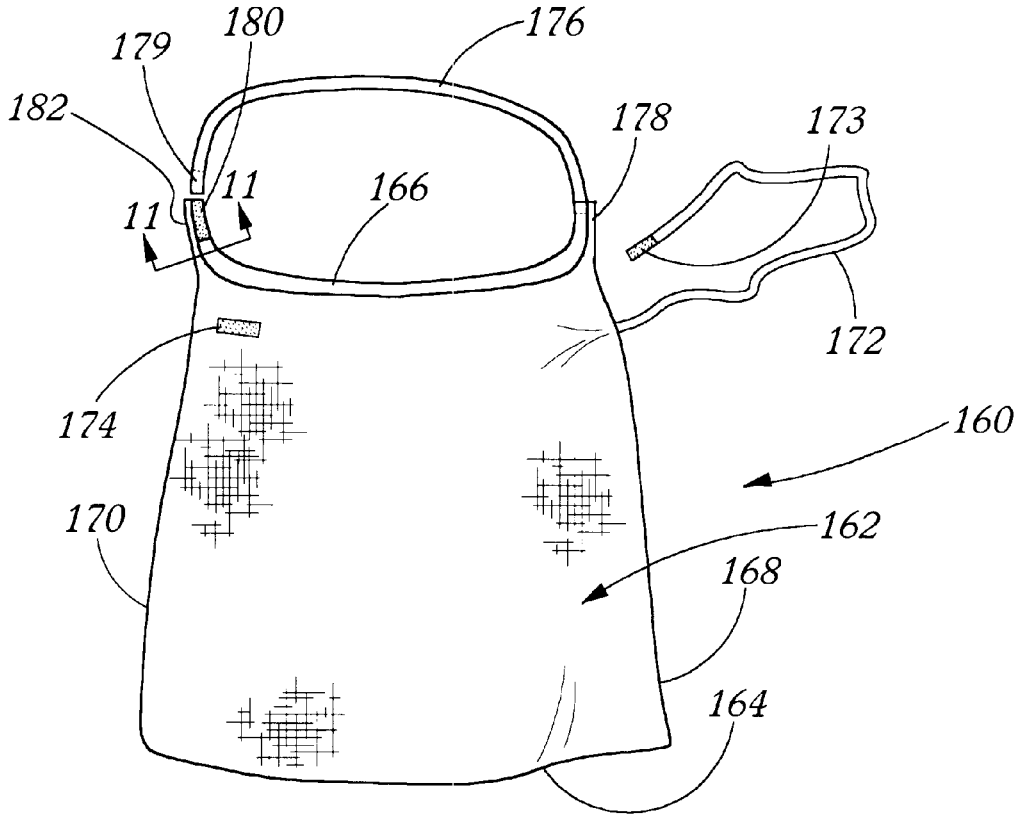
FIG. 10 is a front view in elevation of still another embodiment of a device constructed in accordance with the present invention.
Figure 11:
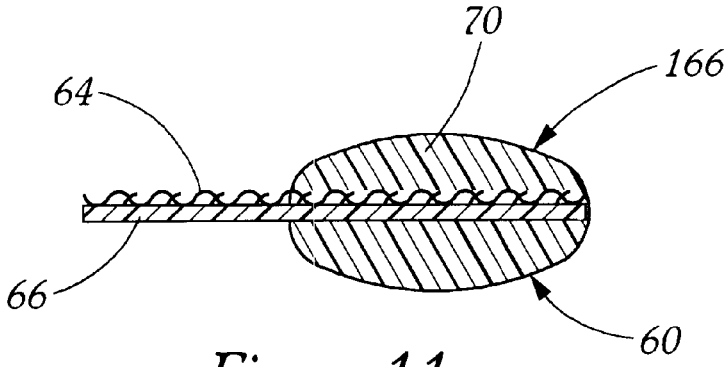
FIG. 11 is a cross-sectional view taken substantially along line 11—11 of FIG. 10.

Each of the flap members 110, 112 include a plurality of attachment elements 132, similar to the elements 80–94 in the prior embodiment, for forming pouches 134 to hold thermal packs 136 (heat or cold) over the breasts of a wearer. In preferred form, the flap member 110 includes an attachment element 138 disposed proximate its bottom edge 116, an upper attachment element 140 disposed proximate the junction of the upper portion 102 and the flap member 110, and third and fourth attachment elements 142, 144 being spaced along the outer edge 114. The attachment elements 138 and 144 are positioned to be secured to the attachment elements 140 and 142, respectively, when the flap member 110 is folded back onto itself as illustrated in FIG. 9. Likewise, the flap member 112 includes a lower attachment element 146 proximate the bottom edge 122, an upper attachment element 148 disposed proximate the junction of the upper portion 102 and the flap member 112, and third and fourth attachment elements 150, 152 spaced along the outer side edge 120. The attachment elements 146 and 152 are positioned to be secured to the attachment elements 148 and 150, respectively, when the flap member 112 is folded back onto itself to form a pouch 134 for the placement of a thermal pack 136. As in the prior embodiment, the attachment element 132 may be placed along the inner side edges 118, 128 leaving the outer side edge 114, 120 open to access the pocket for thermal pack 136.

Another nursing garment 160 is provided in the form of a lap bib sized and shaped for covering and protecting the lower torso and lap areas of a wearer similar to the function of the lower bib member 18 of the first embodiment. In this embodiment, the lap garment 160 includes a main body portion 162 having a bottom edge 164, a top edge 166, and opposing side edges 168, 170. The top edge 166 preferably includes a reinforced body 70 surrounding it to provide comfort and support for the underside of a wearer's breasts, since the top edge 166 is preferably designed to be positioned immediately below and supporting a wearer's breasts. As in the prior embodiment, the lap garment main body portion 162 has a soft liquid absorbent outer layer 64 and a firm, liquid impermeable bottom layer 66.

The lap garment 160 is secured to a wearer by providing a first attachment strap 172 secured at one end to a side edge 168. This first attachment strap 172 is designed to pass around the back of a wearer and includes end attachment element 173 for attachment to a member 174 located proximate the opposite side edge 170. In addition, a second strap member 176 is secured to the main body portion 162 at the junction 178 of the side edge 168 and the top edge 166. This second attachment strap 176 projects out from this junction 178 and is designed to pass over the neck of a wearer. The distal end 179 of the strap 178 is then secured to an attachment strip 180 located at the opposite junction 182 between the top edge 166 and the opposite side edge 170. The second strap 176 is preferably adjustable in length at the connection of the distal end 179 and the strip 180 so that the top edge 166 of the garment 160 may be firmly positioned against the undersides of the breasts of a wearer as desired for support.

Either of the protective and modesty garment 100 or the lap garment 160 can be used by a wearer alone or in combination with the other. In this manner, the combined use of the garments 100 and 160 are functionally the same as use of the combination, nursing bib and thermal carrier device 10 of the first embodiment. However, there may be times when it is desired only to have an upper member for modesty purposes or for carrying and positioning a thermal pack against the breasts. In this instance, the protective and modesty garment 100 alone would suffice. Likewise, there may be instances when it is only desired to cover the lap of an individual, such as when an infant is being bounced on its stomach after feeding. In this instance, then, the lap garment 160 alone would suffice.

As can be seen from the above, the present invention provides an improved device which is designed to protect the outer clothing of a nursing mother during the process of nursing. This is accomplished without cumbersome garments which require the complete covering of all the individual's clothing, such as in a dress or gown form, or without a person's having to remove their clothing. The present invention, in all its forms, is easy to put on and take off yet covers the complete front of the torso of the nursing mother. Moreover, the present invention also addresses the problem of breast engorgement and sensitivity resulting from childbirth and breast-feeding. It provides the ability to selectively form pouches strategically located over the wearer's breasts so that hot or cold packs may be positioned therein according to the needs and desires of the individual wearer.

The foregoing description and the illustrative embodiments of the present invention have been described in detail in varying modifications and alternate embodiments. It should be understood, however, that the foregoing description of the present invention is exemplary only, and that the scope of the present invention is to be limited to the claims as interpreted in view of the prior art. Moreover, the invention illustratively disclosed herein suitably may be practiced in the absence of any element which is not specifically disclosed herein.

We claim:

1. A protective covering to safeguard the clothing of a nursing mother from being soiled during nursing of an infant, said covering comprising:

a first member having an upper portion for positioning about the upper torso of a wearer and a pair of flap members depending from said upper portion and arranged for selective covering of the breasts of the wearer, said upper portion including a top edge adapted to fit the neck of a wearer;

first attachment means for securing said first member about the neck of a wearer;

a second member sized and shaped for covering the lower torso and lap of the wearer and having an upper edge adapted for positioning proximate to and beneath the breasts of the wearer, said second member being attached to said first member such that said flap members extend over said second member upper edge and downwardly toward the waist area of the wearer to provide ease of access to the breasts of the wearer as well as modesty protection during the nursing of an infant; and second attachment means for securing said second member about the torso of a wearer.

2. The protective covering as claimed in claim 1, wherein said second member includes said upper edge, a lower edge and opposing side edges, and wherein said second member is attached to said first member proximate the upper corners of the second member defined by the junction of said upper edge and said opposing side edges.

3. The protective covering as claimed in claim 1, wherein said upper edge of said second member includes a reinforced lip for providing comfort as well as support for the breasts of a wearer during nursing.

4. The protective covering as claimed in claim 1, wherein said first member is constructed from soft, absorbent material, and said second member is constructed from an outer layer of soft, absorbent material and an inner layer of firm, liquid impermeable material.

5. The protective covering as claimed in claim 1, wherein said first member upper portion top edge includes a recess, said first attachment means comprises a pair of first attachment members for securing said first member about the neck of a wearer, and said second attachment means comprises a pair of second attachment members for securing the second member about the torso of a wearer.

6. The protective covering as claimed in claim 1, wherein each said flap member includes a plurality of selectively attachable fastening elements disposed thereon to enable said flap member to form a pocket when folded back onto itself.

7. The protective covering as claimed in claim 6, wherein each said flap member includes side edges in the form of an outer edge and an inner edge, a lower edge, and at least four of said selectively attachable fastening elements, a first said fastening element being disposed proximate said flap member lower edge, a second said fastening element being disposed proximate the junction of said flap member and said first member upper portion, and third and fourth said fastening elements being spaced proximate one said side edge, said first and second fastening elements being adapted for selective attachment with each other and said third and fourth fastening elements being adapted for selective attachment with each other to form said pocket accessible through a side edge of said flap member.

8. The protective covering as claimed in claim 7, wherein said fastening elements comprise hook and loop fasteners.

9. A protective and modesty garment with thermal compress carrying capability for use by a woman breast feeding an infant, said garment comprising a bib member sized and shaped for substantially covering the front torso area of a wearer, said bib member including an upper portion having a cutout neck portion and first attachment means for detachably fastening said bib member around the neck of the wearer, a pair of flaps depending from said upper portion with each said flap being arranged for covering a breast of the wearer and extending downwardly toward the waist area of the wearer to provide selective access to the breasts of the wearer as well as modesty protection during the nursing of an infant, second attachment means for detachably fastening said bib member around the torso of the wearer, and a plurality of fastening elements disposed on each said flap positioned for selective attachment when each said flap is folded back onto itself to form a pouch adapted to carry a thermal compress pack positioned over a breast of the wearer.

10. The garment as claimed in claim 9, wherein said garment further comprises a lap covering member sized and shaped for covering and protecting the lower torso and lap of the wearer and having opposing side edges with an upper edge adapted for positioning proximate to and beneath the breasts of the wearer, said lap covering member including third attachment means for selectively securing said lap covering member about the neck of the wearer and fourth attachment means secured to said side edges for selectively securing said lap covering member about the torso of the wearer such that said flaps of said bib member extend over said lap covering member downwardly toward the waist area of the wearer.

11. The garment as claimed in claim 10, wherein each said flap includes a pair of side edges in the form of an outer edge and an inner edge, a lower edge, and at least four of said selectively attachable fastening elements with a first said fastening element being disposed proximate said flap lower edge, a second said fastening element being disposed proximate the junction of said flap and said bib member upper portion, and third and fourth said fastening elements being spaced along one said flap side edge, said first and second fastening elements being adapted for selective attachment with each other and said third and fourth fastening elements being adapted for selective attachment with each other to form said pouch accessible through the side edge of said flap not containing fastening elements.

12. The garment as claimed in claim 11, wherein said third attachment means comprises a strap projecting from the junction of said upper edge and one said side edge and including a distal end having a detachable fastening member thereon, and an attachment strip disposed at the junction of said upper edge and the opposite side edge for attaching to said distal end detachable fastening member, and wherein said fourth attachment means comprises an adjustable strap for securing said lap covering member to the torso of a wearer while simultaneously selectively holding one or both flaps in position against the torso of a wearer to enable said one or both flaps to be folded back onto itself across said strap.

13. The garment as claimed in claim 11, wherein said upper edge of said lap covering member includes a reinforced lip for providing comfort as well as support for the breasts of a wearer during nursing.

14. The garment as claimed in claim 10, wherein said lap-covering member is secured to said bib member.

15. A nursing garment for a woman breast feeding an infant, said garment comprising a lap bib sized and shaped for covering and protecting the lower torso and lap of a wearer and having an upper edge adapted for positioning proximate to and beneath the breasts of the wearer for support during the nursing of an infant, said lap bib including first attachment means comprising a strap projecting from the junction of said upper edge and one said side edge and including a distal end having a detachable fastening member thereon, and an attachment strip disposed at the junction of said upper edge and the opposite side edge for attaching to said distal end detachable fastening member, and second attachment means for selectively securing said lap bib about the torso of the wearer such that the lap of the wearer is covered and protected from soiling during the nursing of an infant, said lap bib being constructed from an outer layer of soft, absorbent material and an inner layer of firm, liquid impermeable material.

16. The garment as claimed in claim 15, wherein said nursing garment further comprises a chest bib sized and shaped for substantially covering the front torso area of the wearer, said chest bib including an upper portion having a cutout neck portion and third attachment means for detachably fastening said chest bib around the neck of the wearer, a pair of depending flaps each arranged for covering a breast of a wearer and extending downwardly toward the waist area of the wearer to provide selective access to the breasts of the wearer as well as modesty protection during the nursing of an infant, and fourth attachment means for detachably fastening said chest bib around the torso of the wearer, said chest bib being constructed from soft, absorbent material.

17. The garment as claimed in claim 16, wherein said chest bib includes a plurality of fastening members disposed on each said flap positioned for selective attachment when each said flap is folded back onto itself to form a pouch adapted to carry a thermal compress member positioned over a breast of the wearer.

18. The garment as claimed in claim 17, wherein each said flap includes an outer edge, an inner edge, a lower edge, and at least four of said selectively attachable fastening members with a first said fastening member being disposed proximate said flap lower edge, a second said fastening member being disposed proximate the junction of said flap and said chest bib upper portion, and third and fourth said fastening members being spaced along said flap outer edge, said first and second fastening members being adapted for selective attachment with each other and said third and fourth fastening members being adapted for selective attachment with each other to form said pouch accessible through the inner edge of said flap.

19. The garment as claimed in claim 16, wherein said upper edge of said lap bib includes a reinforced lip for providing comfort as well as support for the breasts of a wearer during nursing, and wherein said lap bib is secured to said chest bib.

20. A combination nursing bib comprising:

a first bib member sized and shaped for substantially covering the front torso area of the wearer, said bib member including an upper portion having a cutout neck portion, first attachment means for detachably fastening said first bib member around the neck of a wearer, a pair of flaps depending from said upper portion with each said flap arranged for covering a breast of a wearer, said flaps extending downwardly toward the waist area of the wearer to provide selective access to the breasts of the wearer as well as modesty protection during the nursing of an infant, and second attachment means for detachably fastening said first bib member around the torso of the wearer; and a second bib member sized and shaped for substantially covering and protecting the lower torso and lap of the wearer and having an upper edge adapted for positioning proximate to and beneath the breasts of the wearer, said second bib member including third attachment means proximate said upper edge for selectively securing said second bib member about the torso of the wearer such that said flaps of said first bib member extend over said second bib member downwardly toward the waist area of the wearer.

21. The combination nursing bib as claimed in claim 20, wherein said first bib member includes a plurality of fastening elements disposed on each said flap positioned for selective attachment when each said flap is folded back onto itself to form a pouch adapted to carry a thermal compress member positioned over a breast of the wearer.

22. The combination nursing bib as claimed in claim 21, wherein said second bib member is secured to said first bib member.

23. The combination nursing bib as claimed in claim 21, wherein each said flap includes a pair of opposing side edges in the form of an outer edge and an inner edge, a lower edge, and at least four of said fastening elements with a first said fastening element being disposed proximate said flap lower edge, a second said fastening element being disposed proximate the junction of said flap and said first bib member upper portion, and third and fourth said fastening elements being spaced along one said flap side edge, said first and second fastening elements being adapted for selective attachment with each other and said third and fourth fastening elements being adapted for selective attachment with each other to form said pouch accessible through the unsecured side edge of said flap.

24. A protective covering to safeguard the clothing of a nursing mother from being soiled during nursing of an infant, said covering comprising:

a first member having an upper portion for positioning about the upper torso of a wearer and a pair of flap members depending from said upper portion and arranged for selective covering of the breasts of the wearer; and a second member sized and shaped for covering the lower torso and lap of the wearer and having an upper edge adapted for positioning proximate to and beneath the breasts of the wearer, a lower edge and opposing side edges, said second member being attached to said first member proximate the upper comers of the second member defined by the junction of said upper edge and said opposing side edges such that said flap members extend over said second member upper edge and downwardly toward the waist area of the wearer to provide ease of access to the breasts of the wearer as well as modesty protection during the nursing of an infant.

* * * * *